US007655167B2

(12) United States Patent
Ton

(10) Patent No.: US 7,655,167 B2
(45) Date of Patent: Feb. 2, 2010

(54) SPA APPARATUS

(76) Inventor: Quy That Ton, 3131 Dairymple Dr., Baton Rouge, LA (US) 70808

( * ) Notice: Subject to any disclaimer, the term of this patent is extended or adjusted under 35 U.S.C. 154(b) by 367 days.

(21) Appl. No.: 11/674,277

(22) Filed: Feb. 13, 2007

(65) Prior Publication Data

US 2008/0022453 A1 Jan. 31, 2008

Related U.S. Application Data

(63) Continuation-in-part of application No. 11/464,212, filed on Aug. 14, 2006.

(60) Provisional application No. 60/831,000, filed on Jul. 14, 2006.

(51) Int. Cl.
*B28B 7/22* (2006.01)
*A47K 3/022* (2006.01)

(52) U.S. Cl. ..... 264/255; 264/219; 264/256; 4/622

(58) Field of Classification Search ..... 264/219, 264/255, 256; 4/622
See application file for complete search history.

(56) References Cited

U.S. PATENT DOCUMENTS

| | | | | |
|---|---|---|---|---|
| 4,668,451 | A * | 5/1987 | Langson | 264/39 |
| 2004/0028909 | A1* | 2/2004 | Hodgson et al. | 428/413 |
| 2006/0057393 | A1* | 3/2006 | Reisch et al. | 428/423.1 |
| 2007/0226897 | A1* | 10/2007 | Fugate | 4/622 |
| 2008/0010741 | A1* | 1/2008 | Ton et al. | 4/622 |

* cited by examiner

*Primary Examiner*—Kat Wyrozebski
*Assistant Examiner*—Robert J Grun
(74) *Attorney, Agent, or Firm*—Duane Morris LLP

(57) ABSTRACT

Methods are disclosed for making a base of a spa apparatus to resemble artificial rocks and wood. In one embodiment, the method is comprised of the following steps: making a mold in which its inner surface has the shape and surface texture of a rock or wood; placing a first structure on the inner surface of the mold, the first structure being operative to prevent warping of the base; spraying polymer on the mold; allowing the polymer to harden; and removing the hardened polymer from the mold, the hardened polymer having substantially the shape and surface texture of rock or wood.

15 Claims, 8 Drawing Sheets

SPA APPARATUS

CROSS-REFERENCE TO RELATED APPLICATION

This application is a continuation-in-part of copending U.S. utility application entitled, "PROCEDURE FOR MOLDING OF AN ARTIFICIAL ROCK OR WOOD," having Ser. No. 11/464,212, filed on Aug. 14, 2006, which is entirely incorporated herein by reference and claims the benefit of U.S. provisional application entitled, "PROCEDURE FOR MOLDING OF AN ARTIFICIAL ROCK OR WOOD," having Ser. No. 60/831,000, filed on Jul. 14, 2006, which is entirely incorporated herein by reference.

TECHNICAL FIELD

This disclosure relates to a method of making artificial rocks, rock formations, and wood, and more particularly to a method of making a base of a spa apparatus that resembles a rock or wood.

BACKGROUND

The pedicure industry is expanding in today's economy. Many pedicure salons have spa apparatuses in which customers sit at the spa apparatuses where technicians can provide pedicure services as well as spa services. Typically, each base of the spa apparatuses is made of plastic and does not resemble natural rocks, rock formations, and natural wood. In addition, artificial rocks, rock formations, and wood are typically made of plastic or cement. Cement is often used to provide the authenticity of a rock or wood. For example, a method of making artificial rock formation is disclosed in U.S. Pat. No. 4,668,451, to Langson. Langson discloses that cement is applied to the inner surface of a mold. When the mold is removed, the cement resembles the natural rock surface. Cement takes hours to harden and this causes delay in manufacturing artificial rocks, rock formations, and wood.

SUMMARY

Methods are disclosed for making a base of a spa apparatus to resemble artificial rocks and wood. In one embodiment, the method is comprised of the following steps: making a mold in which its inner surface has the shape and surface texture of a rock or wood; placing a first structure on the inner surface of the mold, the first structure being operative to prevent warping of the base; spraying polymer on the mold; allowing the polymer to harden; and removing the hardened polymer from the mold, the hardened polymer having substantially the shape and surface texture of rock or wood.

A spa apparatus is disclosed herein. In one embodiment, the spa apparatus is comprised of a chair, a basin, and a base. Such base is made of hardened polymer having substantially the shape and surface texture of rock or wood, the base including a first structure that is disposed on top of the base, the first structure being operative to prevent the warping of the hardened polymer. The chair and basin is typically attached on top of the base.

Other apparatuses, methods, features, and advantages of the present disclosure will be or become apparent to one with skill in the art upon examination of the following drawings and detailed description. It is intended that all such additional apparatuses, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
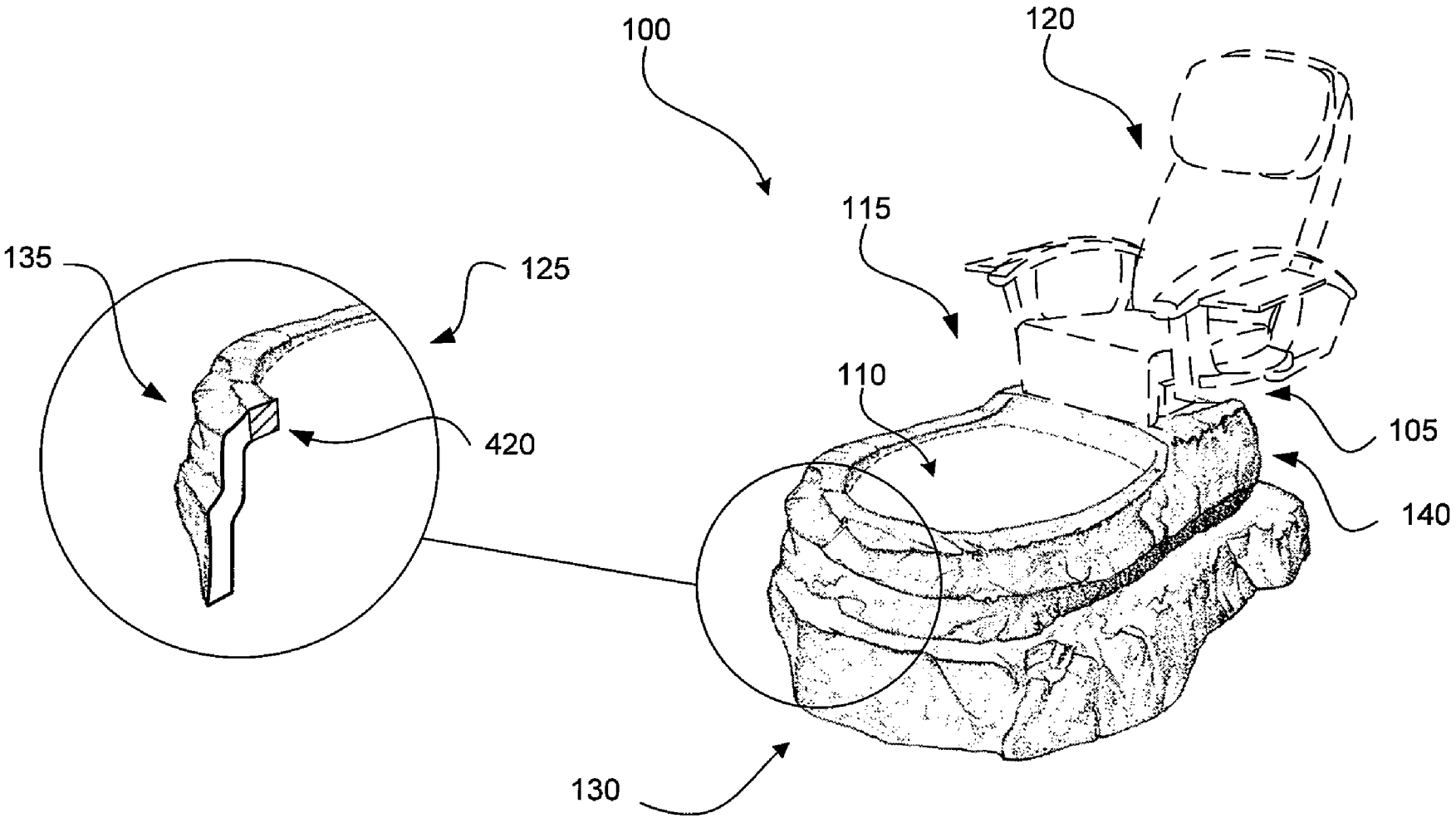
FIG. 1 depicts an embodiment of a base of a spa apparatus that resembles a rock formation.

FIG. 1 depicts an embodiment of a base of a spa apparatus that resembles a rock formation. It should be noted that the base can also be made to resemble wood. The base 100 generally includes a seating portion 105 that is disposed on the top 115 and towards the rear 140 of the base 100. A chair 120 is generally attached on top of the seating portion 105. A basin 110 is generally disposed on the top 115 and towards the front 130 of the base 100. The basin 110 is generally located adjacent to the seating portion 105, where water is filled and a person's feet can be submersed in. A foot rest (not shown) can be place adjacent to the basin 110 opposite from seating portion 105. The base 100 of the spa apparatus, from a top view, can have the shape of, such as, but not limited to, a rectangle, circle, ellipse, hexagon, and octagon, among others. A cross-sectional view 125 of a front portion 130 of the base 100 shows the outer shape and the surface texture 135 of the artificial rock, which are described later in relation to FIG. 2.

Figure 2:
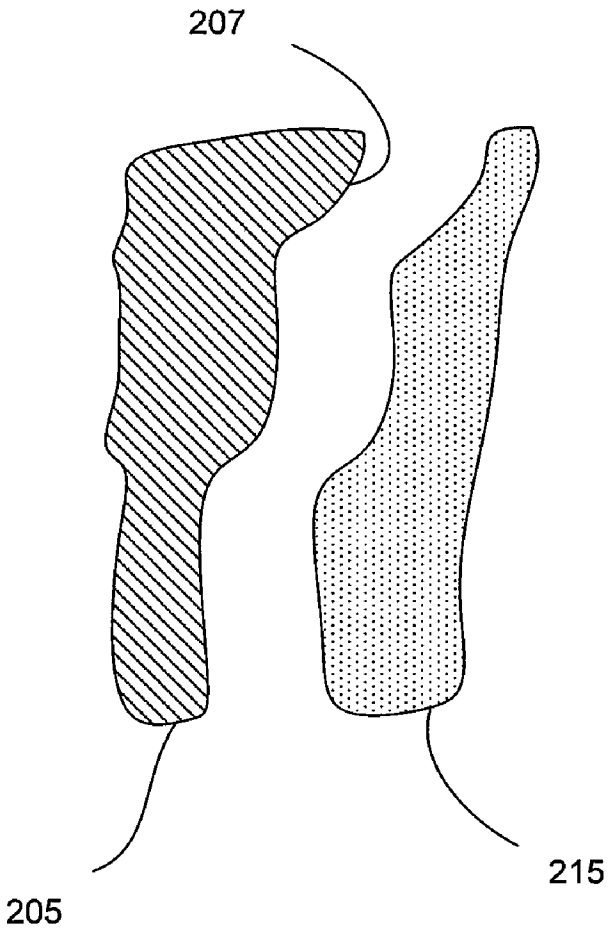
FIG. 2 depicts a cross-sectional view illustrating layers of materials used during a procedure of making an artificial rock, such as that shown in FIG. 1.

FIG. 2 depicts a cross-sectional view illustrating layers of materials used during a procedure of making an artificial rock, such as that shown in FIG. 1. The artificial rock is generally made by way of a molding process that shapes pliable raw material, using a frame or model called a mold 205. The mold 205 is a hollowed-out block that is filled with a liquid, such as, but not limited to, glass, metal, silicone, polyurethane/polyurea, latex, and any other plastic materials, among others. The liquid hardens or sets inside the mold 205, adopting its shape. In this instance, an interior surface 207 of the mold 205 resembles the outer shape and the surface texture 135, such as that shown in the cross-sectional view 125 of a front portion 130 of the base 100 in FIG. 1. Referring back to FIG. 2, after the mold 205 is made, a layer of polymer 210, such as polyurethane, is applied on the inner surface 207 of the mold 205, forming an outer shell 210. Alternatively or additionally, after the outer shell 210 hardens, a hardcoat 215, such as urethane, polyurea, fiberglass, or glass fiber reinforced cement (GFRC), can be applied on the outer shell 210.

Once the outer shell 210 and hardcoat 215 within the mold harden, the mold 205 is pulled off of the outer shell 210; the result is a base of a spa apparatus that has the appearance of a rock or wood.

Alternatively or additionally, cementitious material instead of polymers can be used to form the outer shell 210. The cementitious material includes, but is not limited to, cement, GFRC, and glass fiber reinforcement, among others. The GFRC is a cement-based composite containing glass fibers for reinforcement. The GFRC is substantially lower in weight than plain concrete, with higher flexural and compressive strengths.

Alternatively or additionally, acrylic and/or resin-modified cementitious material can be used in conjunction with the hardcoat 215 to form the base resembling a rock or wood. The hardcoat 215 includes, but is not limited to, polyurea/polyurethane hybrid, among others. The acrylic and/or resin-modified cementitious material reinforced with the hardcoat hardens more quickly than cement; thus, more artificial rocks can be manufactured in a shorter period of time.

Figure 3:
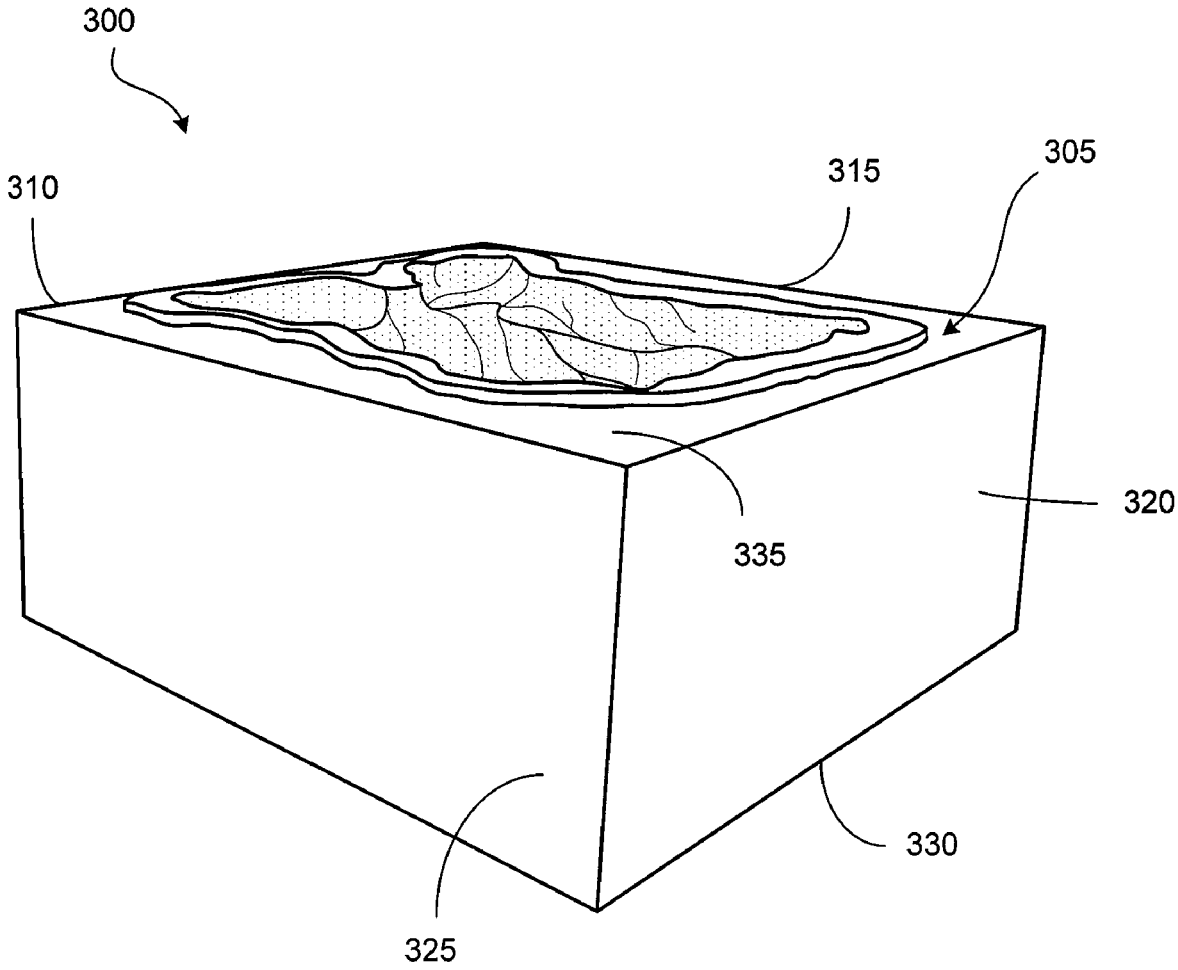
FIG. 3 is a perspective view showing the front, left and upper sides of a backing mold that facilitates making of a base of a spa apparatus to resemble a rock.

FIG. 3 is a perspective view showing the front, left and upper sides of a backing mold 300 that facilitates making a base of a spa apparatus to resemble a rock. The backing mold 300 aids in the uniformity and interchangeability of making an artificial rock. The backing mold 300 includes four sidewalls 310, 315, 320, 325, a bottom wall 330 and a top wall 335. The top wall 335 includes an opening in which a mold 305, such as that described in FIG. 2, is placed therein. Alternatively or additionally, the mold 305 can be made in one piece. An advantage, among others, is that no disassembly and reassembly is required between castings. If for some reason the mold 305 is deemed unusable (torn, cut with a knife, etc.), a new mold can be poured using the same backing mold. It is believe that in any other mold making system, a new mold requires a new backing mold.

Figure 4:
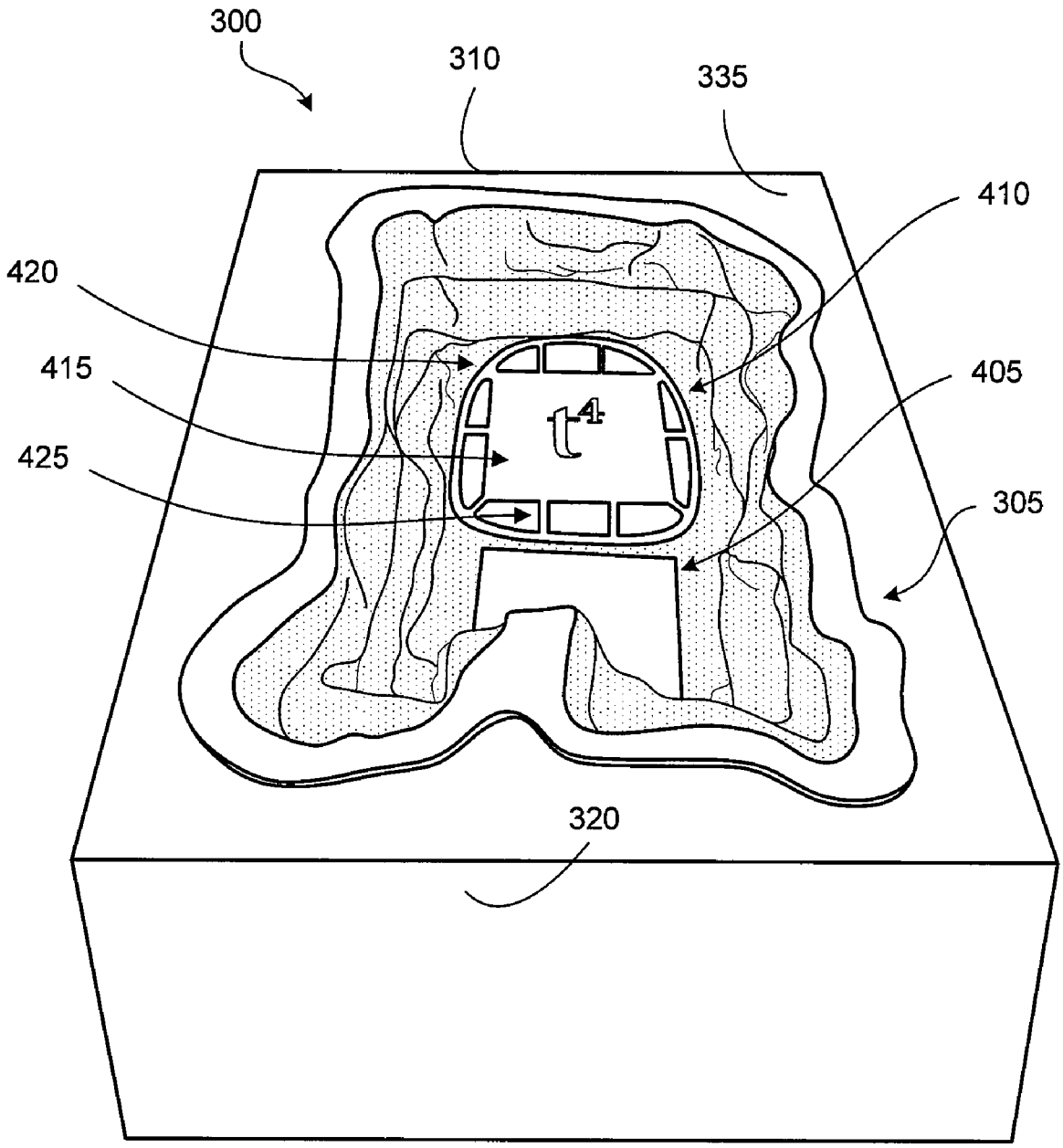
FIG. 4 is a perspective view showing the front and upper sides of a backing mold, such as that shown in FIG. 3.

FIG. 4 is a perspective view showing the front and upper sides of a backing mold 300, such as that shown in FIG. 3. The mold 305 is placed in an opening of the top wall 335 in which an inner surface of the mold is exposed toward the top wall 335 of the backing mold 300. The mold 305 facilitates the making of the artificial rock base 100, such as that shown in FIG. 1. A support component 405 is placed on, for example, the inner surface and at the bottom of the mold 305 towards the front wall 320 of the backing mold 300. Generally, the support component 405 includes a rectangular structure that can be made out of wood. A pedispa chair 120, such as that shown in FIG. 1, is generally placed on the support component 405. It should be noted that the support component 405 can be any shape, such as circular, oval, square, pentagonal, hexagonal, heptagonal, and octagonal, among others, as long as the support component 405 facilitates attaching and supporting, for example, a pedispa chair as well as a customer sitting on the chair.

A circular or oval structure 410 is placed on the inner surface and at the bottom of the mold 305 towards the rear 310 of the backing mold 300. The oval structure 410 is generally adjacent to the support component 405. The oval structure 410 can preserve an opening on the mold in which a spa bowl or basin (not shown) can be inserted into the opening to rest flushed against the dried, hardened composite. The oval structure 410 is comprised of an oval bar 420 and a rectangular center 415, which are generally attached by a plurality of bars 425. In this example, two corners of the rectangular center are also attached to the oval bar. The bars 425 and rectangular center 415 prevent the oval bar and the hardened composite from warping during the process of making the artificial rock.

It should be noted that the structure 410 can be any shape other than oval, such as circular, rectangular, square, pentagonal, hexagonal, heptagonal, and octagonal, among others.

Figure 5:
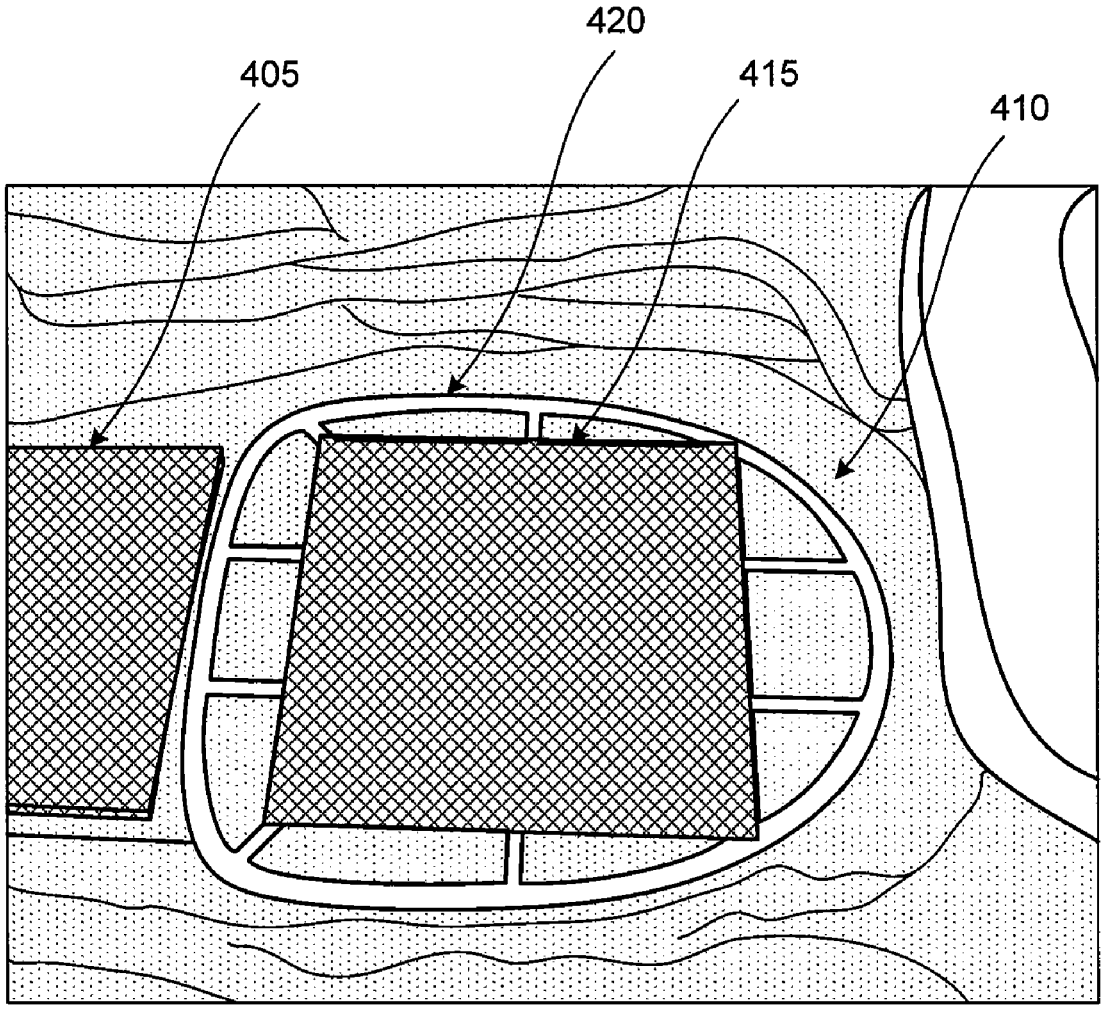
FIG. 5 is a top view of an oval structure, such as that shown in FIG. 4.

FIG. 5 is a top view of an oval structure 410, such as that shown in FIG. 4. The rectangular center 415 can be covered with, for example, a thin, flexible, plastic sheet, during the process of spraying polymers in the mold 305. The rectangular center 415 can be removed from the oval bar 420 so that the rectangular center 415 can be used in making other artificial rocks. Alternatively or additionally, the support component 405 can also be covered with a thin, flexible, plastic sheet.

Figure 6:
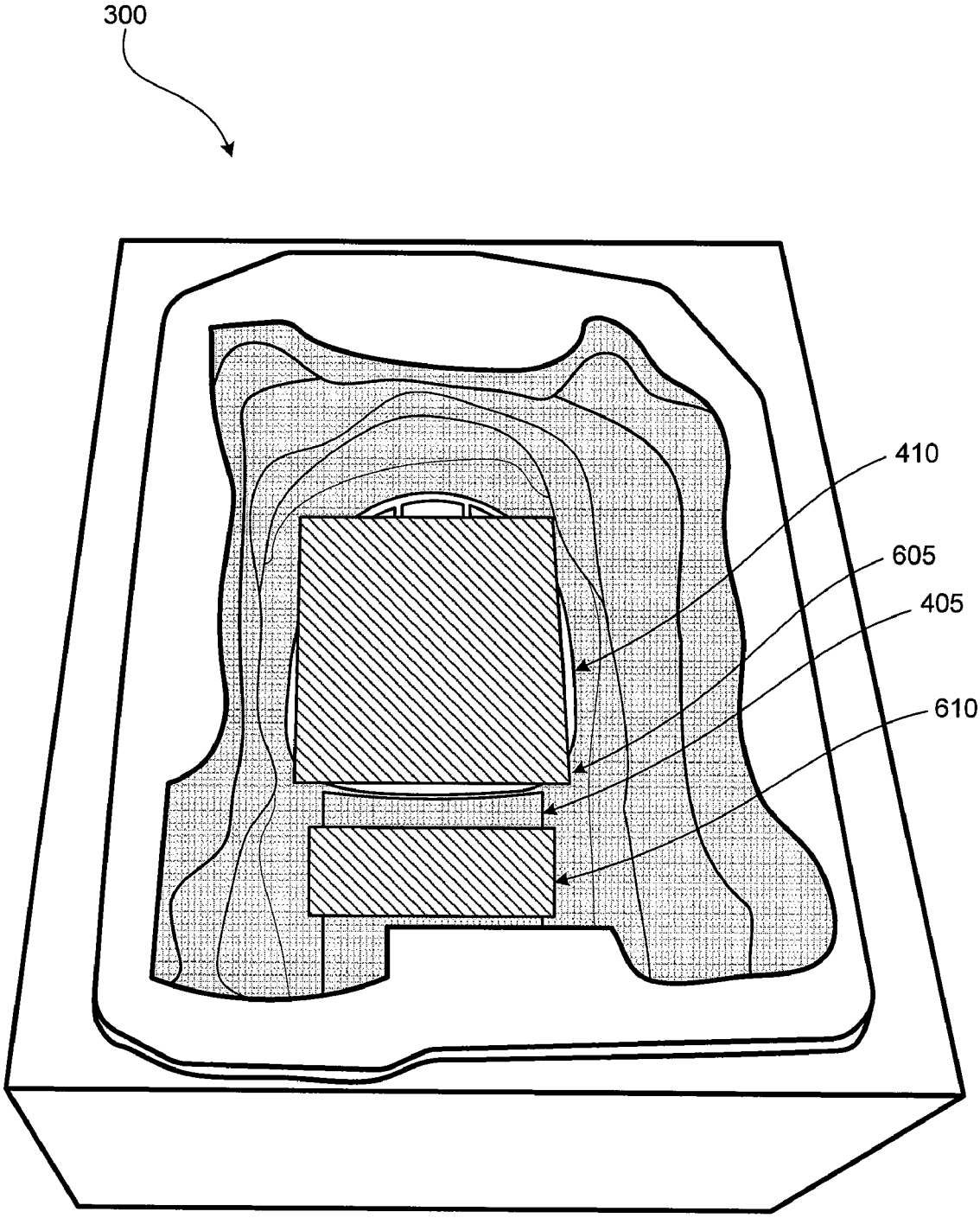
FIG. 6 is a perspective view showing the front and upper sides of a backing molding, such as that shown in FIG. 3.

FIG. 6 is a perspective view showing the front and top of a backing mold 300, such as that shown in FIG. 3. Weights 605, 610 are placed on top of the support component 405 and oval structure 410 so that pressure can be applied to the support component 405 and oval structure 410 to seal them substantially air-tight to the mold 305. The weights 605, 610 can include a thirty pound metal plate, among others. Alternatively and/or additionally, the weight 610 that is placed on top of the support component 405 can be used to provide support for a massage chair and a customer sitting on the chair.

Figure 7A:
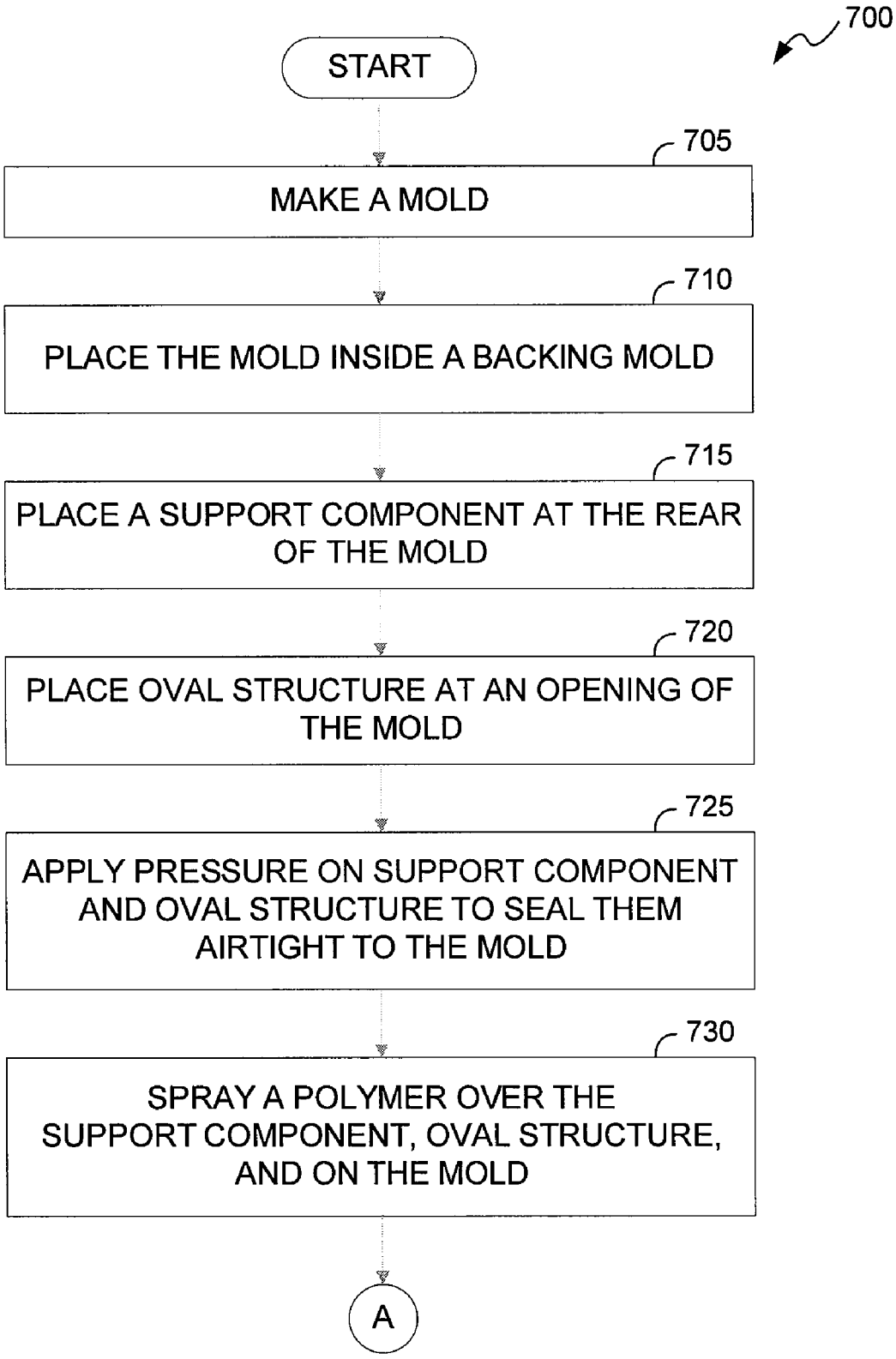
FIGS. 7A-B are flow diagrams that illustrate operation of an embodiment of making a base of a spa apparatus to resemble a rock.
Figure 7B:
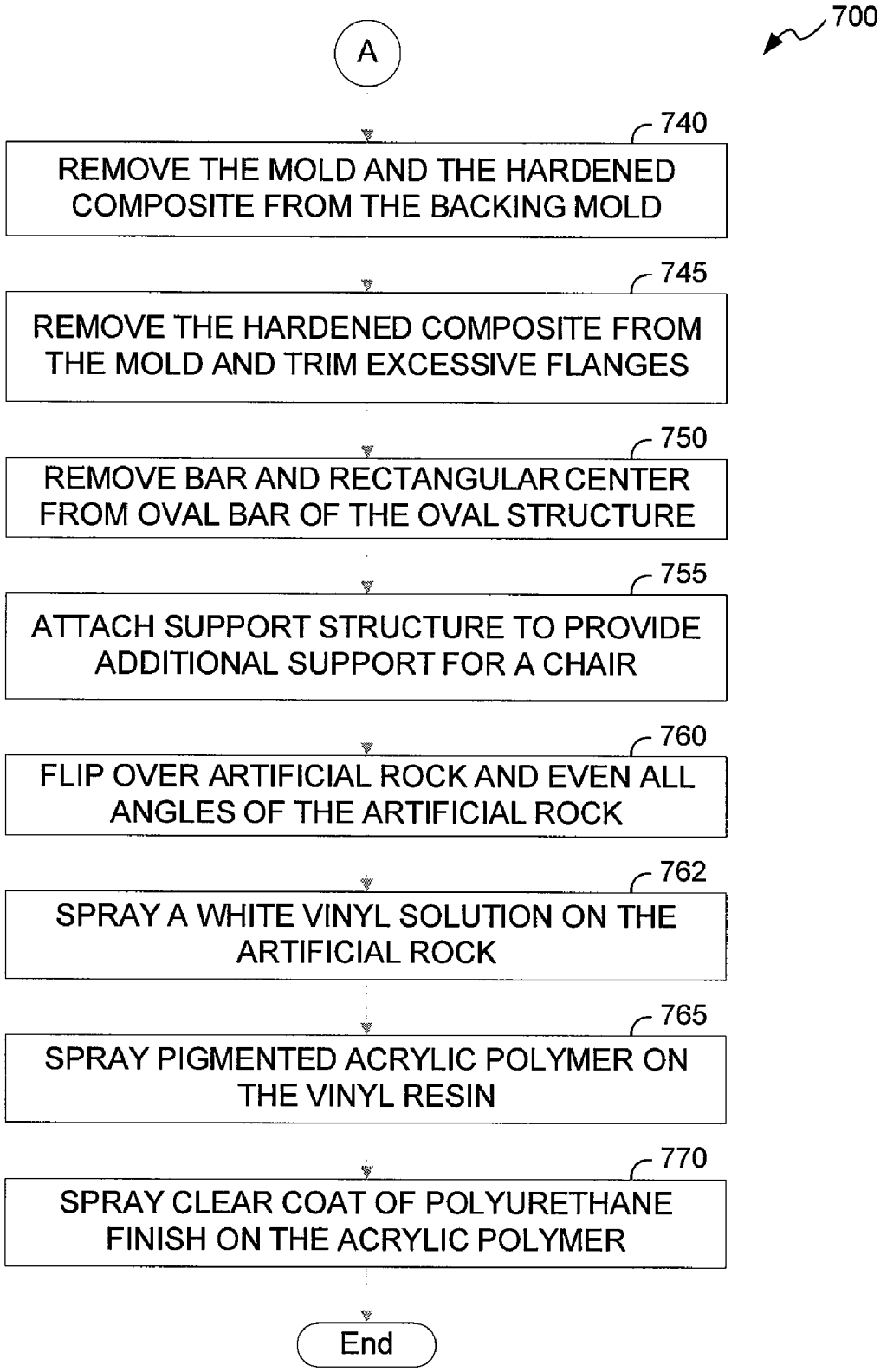

FIGS. 7A-B are flow diagrams that illustrate operation 700 of an embodiment of making a base of a spa apparatus to resemble a rock. Beginning with block 705, the operation 700 is comprised of making a mold of a rock, rock formation, or wood. There are various ways of making a mold. In one embodiment, the method begins with locating a natural rock or wood that is to be used for its shape and surface texture. The rock includes, but is not limited to, a rock, boulder, combination of rocks, and cliffs, among others. The wood includes, but is not limited to, a tree and a combination of a trunk and root of the tree. The surface of the rock or wood to be molded is cleaned, and flanges are installed if needed. The rock or wood is allowed to dry and then is coated with a few coats of silicone urethane latex using a paint brush or airless sprayer with drying time between each coat. It should be noted that other materials can be used in place of latex, such as, but not limited to, silicone, urethane, or other similar materials.

The latex is applied with a few layers of cheesecloth with drying time between each layer. Other materials can be used in place of cheesecloth, such as burlap and nylon mesh. The dried cheesecloth is then applied with a few more coats of latex to seal against moisture. The latex is then dried, and flanges are placed on the latex if needed. The dried latex is coated with a bond release, and the bond release is coated with fiberglass or polyurea/polyurethane. The fiberglass and latex are peeled off, forming the mold.

In block 710, the mold is placed inside a backing mold. The backing mold allows the mold to retain its shape during the process of making the base of the spa apparatus to resemble the rock. In block 715, once the mold is placed in the backing mold, a support component is placed at, for example, the bottom of the mold. The support component facilitates attaching and supporting a pedispa chair as well as a customer sitting on the chair. The support component further facilitates preventing the hardened composite from warping during the process of making the artificial rock.

In block 720, an oval structure is placed at an opening of the mold, which is, generally, at the bottom of the mold and adjacent to the support component. The oval structure can be removed from the mold to preserve the opening of the mold in which a spa bowl can be inserted into the opening to rest flushed against the dried, hardened composite. In block 725, pressure can be applied to the support component and oval structure to seal the support component and oval structure substantially air-tight to the mold. Generally, weights are placed on top of the support component and oval component.

In block 730, a vinyl resin solution is sprayed on the mold. The vinyl resin solution is allowed to dry and harden. An advantage, among others, of spraying vinyl resin solution on the mold is that the artificial rock can be separated from the mold later in the process. In block 735, a polyurethane, acrylic polymer is sprayed at the edge of the support component and oval structure. It is allowed to dry and harden. The weights are then removed. The polyurethane, acrylic polymer is also sprayed on top of the vinyl resin solution, support component, oval structure, and sprayed edges. The polymer is then allowed to dry and harden.

In block 740, the mold and the hardened composite are removed from the backing mold. In block 745, the hardened composite is removed from the mold. The composite should resemble a rock formation. In general, the hardened composite has flanges at the bottom of the composite, which is trimmed with, for example, a router slotting blade or other cutting device. In block 750, the bars and rectangular center of the oval component are removed from the oval bar. It should be noted that the rectangular center can be used for making other artificial rocks.

In block 755, a support structure is attached to the support component by applying silicone, liquid nails or any adhesive products, for example. The support structure provides additional support to, for example, a massage chair. The support structure can include a framed box that is designed to have substantially a height from the support component to the bottom of the artificial rock. In block 760, the artificial rock is flipped over and all angles of the artificial rock are ensured even. In block 765, an acrylic polymer mixed with colored pigments is sprayed on the vinyl resin solution that aids the composite to better resemble a rock in shape and color. In block 770, a clear coat of polyurethane finish is sprayed on the acrylic polymer to preserve the rock formation exterior and color.

It should be emphasized that the above-described embodiments are merely possible examples of implementations, merely set forth for a clear understanding of the principles of the disclosure. Many variations and modifications may be made to the above-described embodiments without departing substantially from the spirit and principles of the disclosure. All such modifications and variations are intended to be included herein within the scope of this disclosure and the present disclosure and protected by the following claims.

Therefore, having thus described the invention, at least the following is claimed:

1. A method for making a base of a spa apparatus to resemble rock or wood, the method comprising the steps of:

making a mold in which its inner surface has the shape and surface texture of a rock or wood;

placing a first structure on the inner surface of the mold, the first structure being operative to prevent warping of the base; spraying polymer on the mold;

allowing the polymer to harden;

removing the hardened polymer from the mold, the hardened polymer having substantially the shape and surface texture of rock or wood; and placing a support component at the bottom of the mold adjacent to the first structure, the support component being operative to facilitate supporting a chair attached on the support component, wherein the first structure preserves an opening on the base.

2. The method as defined in claim 1, further comprising placing the mold inside a backing mold in which the inner surface of the mold is exposed.

3. The method as defined in claim 1, further comprising attaching a support structure on a support component to provide support for a chair.

4. The method as defined in claim 1, further comprising removing the mold and the hardened polymer from the backing mold.

5. The method as defined in claim 1, further comprising spraying vinyl solution on the mold before spraying the polymer.

6. The method as defined in claim 5, further comprising spraying an acrylic polymer on the vinyl solution.

7. The method as defined in claim 6, further comprising spraying polyurethane finish on the acrylic polymer.

8. A method for making a base of a spa apparatus to resemble rock or wood, the method comprising the steps of:

making a mold in which its inner surface has the shape and surface texture of a rock or wood;

placing a first structure on the inner surface of the mold, the first structure being operative to prevent warping of the base; spraying polymer on the mold;

allowing the polymer to harden;

removing the hardened polymer from the mold, the hardened polymer having substantially the shape and surface texture of rock or wood; and applying pressure on the first structure to seal the first structure substantially air-tight to the mold.

9. A method for making a base of a spa apparatus to resemble rock or wood, the method comprising the steps of:

making a mold in which its inner surface has the shape and surface texture of a rock or wood;

placing a first structure on the inner surface of the mold, the first structure being operative to prevent warping of the base; spraying polymer on the mold;

allowing the polymer to harden;

removing the hardened polymer from the mold, the hardened polymer having substantially the shape and surface texture of rock or wood, wherein placing the first structure further comprises placing the first structure at substantially the center of the mold, wherein the first structure includes an oval bar that is attached to a rectangular center via bars.

10. The method as defined in claim 9, further comprising removing a center component of the first structure creating the opening of the artificial rock.

11. A method for making a base of a spa apparatus to resemble rock or wood, the method comprising the steps of:

making a mold in which its inner surface has the shape and surface texture of a rock or wood;

placing a first structure on the inner surface of the mold, the first structure being operative to prevent warping of the base; spraying polymer on the mold;

allowing the polymer to harden;

removing the hardened polymer from the mold, the hardened polymer having substantially the shape and surface texture of rock or wood; and spraying cementitious material on the polymer, the cementitious material including acrylic and/or resin-modified cementitious material; applying a hardcoat on the cementitious material; allowing the cementitious material and the hardcoat to harden; and removing the mold, the hardened cementitious material and hardcoat having the shape and surface texture of rock or wood, wherein applying cementitious material comprises applying fiberglass in conjunction with the cementitious material.

12. The method as defined in claim 11, wherein the hardcoat includes one of the following: polyurea/polyurethane hybrid, urethane, polyurea, fiberglass, and GFRC.

13. The method as defined in claim 11, wherein the cementitious material further includes one of cement, glass fiber reinforced cement (GFRC), and glass fiber reinforcement.

14. The method as defined in claim 11, further comprising attaching a basin on the first structure.

15. The method as defined in claim 11, further comprising attaching a chair on the support component.

* * * * *